US010710371B1

(12) United States Patent
Kalb et al.

(10) Patent No.: US 10,710,371 B1
(45) Date of Patent: Jul. 14, 2020

(54) INKJET PRINTHEAD CAP HAVING LATCHING SYSTEM

(71) Applicant: Xerox Corporation, Norwalk, CT (US)

(72) Inventors: Richard A. Kalb, Rochester, NY (US); Douglas A. Gutberlet, Ontario, NY (US); Patrick J. Howe, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/272,104

(22) Filed: Feb. 11, 2019

(51) Int. Cl.
*B41J 2/165* (2006.01)

(52) U.S. Cl.
CPC ..... *B41J 2/16511* (2013.01); *B41J 2/16552* (2013.01); *B41J 2002/16502* (2013.01)

(58) Field of Classification Search
CPC ..... B41J 2/16511; B41J 2/16552; B41J 2002/16502
See application file for complete search history.

(56) References Cited

U.S. PATENT DOCUMENTS

| | | | | |
|---|---|---|---|---|
| 4,296,418 | A | 10/1981 | Yamazaki et al. | |
| 4,364,065 | A | 12/1982 | Yamamori et al. | |
| 4,571,601 | A | 2/1986 | Teshima | |
| 4,746,938 | A | 5/1988 | Yamamori et al. | |
| 4,947,187 | A | 8/1990 | Iwagami | |
| 5,300,958 | A | 4/1994 | Burke et al. | |
| 5,394,178 | A | 2/1995 | Grange | |
| 5,412,411 | A | 5/1995 | Anderson | |
| 5,635,965 | A | 6/1997 | Purwins et al. | |
| 5,663,751 | A | 9/1997 | Holbrook | |
| 5,670,997 | A | 9/1997 | Sugimoto et al. | |
| 5,726,692 | A * | 3/1998 | Yamaguchi | B41J 2/16511 347/10 |
| 5,936,647 | A | 8/1999 | Rhodes et al. | |
| 5,949,448 | A | 9/1999 | Man et al. | |
| 5,980,622 | A | 11/1999 | Byers | |
| 6,106,098 | A * | 8/2000 | Nakamura | B41J 2/16508 347/30 |

(Continued)

FOREIGN PATENT DOCUMENTS

| | | |
|---|---|---|
| DE | 102011002727 A1 | 7/2012 |
| EP | 1 827 839 B1 | 2/2009 |

(Continued)

OTHER PUBLICATIONS

Kwon et al., "Measurement of Inkjet First-Drop Behavior Using a High-Speed Camera," Review of Scientific Instruments; vol. 87, Issue 3, 2016, AIP Publishing, pp. 1-11.

*Primary Examiner* — Justin Seo
(74) *Attorney, Agent, or Firm* — Gibb & Riley, LLC

(57) ABSTRACT

Exemplary printing apparatuses include, among other components, a printhead structure that includes nozzles adapted to eject liquid ink, a carriage assembly having positioning structures, and one or more printhead caps or cups within the carriage assembly. The carriage assembly is shaped to latch to the printhead structure. The printhead includes corresponding structures and the positioning structures engage with the corresponding structures when the carriage assembly is latched to the printhead structure. Also, the printhead caps are positioned within the carriage assembly so as to cover the nozzles when the carriage assembly is connected to the printhead structure.

17 Claims, 16 Drawing Sheets

(56) References Cited

U.S. PATENT DOCUMENTS

| | | | | |
|---|---|---|---|---|
| 6,135,585 | A | 10/2000 | Johnson et al. | |
| 6,508,533 | B2 | 1/2003 | Tsujimoto et al. | |
| 6,726,304 | B2 | 4/2004 | Fassler et al. | |
| 7,156,514 | B2 | 1/2007 | Rosa | |
| 7,753,475 | B2 | 7/2010 | Berry et al. | |
| 7,810,899 | B2 | 10/2010 | Usui et al. | |
| 7,992,986 | B2 | 8/2011 | Snyder et al. | |
| 8,592,503 | B2 | 11/2013 | Bogale et al. | |
| 2001/0026299 | A1 | 10/2001 | Tsujimoto et al. | |
| 2002/0180853 | A1 | 12/2002 | Ohsawa et al. | |
| 2003/0227505 | A1* | 12/2003 | Tanaka | B41J 2/16511 347/29 |
| 2003/0231222 | A1 | 12/2003 | Jefferson et al. | |
| 2006/0119645 | A1* | 6/2006 | Berry | B41J 2/16511 347/29 |
| 2006/0164460 | A1* | 7/2006 | Uwagaki | B41J 2/16544 347/32 |
| 2007/0046721 | A1* | 3/2007 | Miyazawa | B41J 2/16508 347/29 |
| 2007/0076045 | A1* | 4/2007 | James | B41J 2/16547 347/29 |
| 2007/0085875 | A1* | 4/2007 | Shimazaki | B41J 2/16511 347/32 |
| 2007/0252863 | A1 | 11/2007 | Sun et al. | |
| 2007/0263026 | A1 | 11/2007 | Shang et al. | |
| 2008/0018677 | A1 | 1/2008 | White et al. | |
| 2008/0024532 | A1 | 1/2008 | Kim | |
| 2008/0204501 | A1 | 8/2008 | Kurita et al. | |
| 2009/0174748 | A1* | 7/2009 | Balcan | B41J 2/16547 347/32 |
| 2009/0237424 | A1 | 9/2009 | Martin et al. | |
| 2010/0073445 | A1 | 3/2010 | Silverbrook et al. | |
| 2011/0080443 | A1 | 4/2011 | Teramae | |
| 2012/0162311 | A1 | 6/2012 | Taira | |
| 2013/0215189 | A1 | 8/2013 | Justice et al. | |
| 2017/0072720 | A1* | 3/2017 | Yamagishi | B41J 25/006 |
| 2017/0203573 | A1 | 7/2017 | Hiramoto | |
| 2018/0079217 | A1 | 3/2018 | Hiratsuka et al. | |
| 2018/0244048 | A1 | 8/2018 | Ito | |

FOREIGN PATENT DOCUMENTS

| | | | |
|---|---|---|---|
| JP | 4937785 | B2 | 5/2012 |
| KR | 10-1397307 | B1 | 5/2014 |
| WO | 2008026417 | A1 | 3/2008 |

* cited by examiner

INKJET PRINTHEAD CAP HAVING LATCHING SYSTEM

BACKGROUND

Systems and methods herein generally relate to inkjet printers and more particularly to inkjet printhead caps having latching systems.

Inkjet printers eject drops of liquid marking material (e.g., ink) from nozzles or "jets" of printheads in patterns to perform printing. These nozzles of the inkjet printheads routinely clog when such are unused for extended periods, for example when an inkjet printer does not print for an extended period, or when certain colors or nozzles go unused for an extended period.

This can result in nozzles that do not eject any ink, or that only eject a significantly reduced drop mass, which causes less than optimal pixel placement ("streaky" solid-fill images) and lower than target drop mass (lighter than target solid-densities). If the condition goes uncorrected, it can lead to intermittent firing and the jet can eventually cease firing, and such a situation can be unrecoverable resulting in irreversible printhead damage. Depending on the pre-condition of the head, the time scale for onset of such unrecoverable failure could range from a few hours to an overnight/weekend idle time.

Additionally, certain colors (e.g., magenta, etc.) are more susceptible to clogging relative to other colors, because certain color inks dry faster than other color inks, which causes the ink to dry in the nozzles of the printhead during extended inactivity. Such nozzle clogging issues can be mitigated, but not avoided, by purge and cleaning cycles.

SUMMARY

In order to address such issues, exemplary printing apparatuses include, among other components, a printhead structure that has nozzles adapted to eject liquid ink, a carriage assembly having positioning structures, and one or more printhead caps or cups within the carriage assembly. The carriage assembly is shaped to latch to the printhead structure. The printhead has corresponding structures and the positioning structures engage with the corresponding structures when the carriage assembly is latched to the printhead structure. Also, the printhead caps are positioned within the carriage assembly so as to cover the nozzles when the carriage assembly is connected to the printhead structure.

The corresponding structures of the printhead structure can be, for example, slots or openings; and the positioning structures can be wheels or pins that are positioned to engage these slots/openings when the carriage assembly is connected to the printhead structure. Also, a lever structure is connected to some of the positioning structures, where movement of the lever engages the positioning structures of the carriage assembly with the corresponding structures of the printhead structure to latch the carriage assembly to the printhead structure.

A cap support plate can be included within the carriage assembly, and the printhead caps can be, for example, replaceable cups mounted on the cap support plate. The replaceable cups have an opening sized larger than a perimeter of the printheads to allow the printheads to enter the cup openings, and the replaceable cups have a cup interior that is shaped to maintain a liquid and that is sized to allow the printheads to be immersed in the liquid when the nozzles are inserted into the cups. The cap support plate can be within a support tray, and the support tray is shaped to collect any liquids that may flow out of portions of the cap, such as the cups. Also, springs can be included between portions of the printhead cap and the cap support plate to bias the printhead cap against the nozzles. Such structures can further include an applicator within the cap. Such an applicator is positioned within the printhead cap to rest against the nozzles when the carriage assembly is connected to the printhead structure.

Various methods herein maintain ink stabilizing material in one or more printhead caps of a carriage assembly. These methods position a printhead structure in a non-printing position within a printing apparatus and latch the carriage assembly to the printhead structure by engaging positioning structures of the carriage assembly with corresponding structures of the printhead structure.

As noted above, the corresponding structures of the printhead structure can be slots/openings and the positioning structures can be wheels/pins; and the process of connecting the carriage assembly to the printhead structure can be performed, for example, by engaging the wheels within the slots. Further, this process of connecting the carriage assembly to the printhead structure can include a process of moving a lever structure that is connected to the positioning structures so as to engage the positioning structures with the corresponding structures of the printhead structure. This latching process can use springs between the printhead cap and the cap support plate to bias the printhead cap against the nozzles.

With these methods the ink stabilizing material is maintained in the printhead caps by, for example, supplying the ink stabilizing material to an applicator within the cap. When the carriage assembly is connected to the printhead structure, the printhead cap of the carriage assembly covers nozzles of the printhead structure. With such, the applicator is positioned within the printhead cap to rest against the nozzles when the carriage assembly is connected to the printhead structure. Also, such methods can collect liquids that flow out of the printhead cap using a support tray that the cap is within. After storage, the carriage assembly is disconnected from the printhead structure and these methods perform printing using the printhead structure by ejecting ink from the nozzles.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
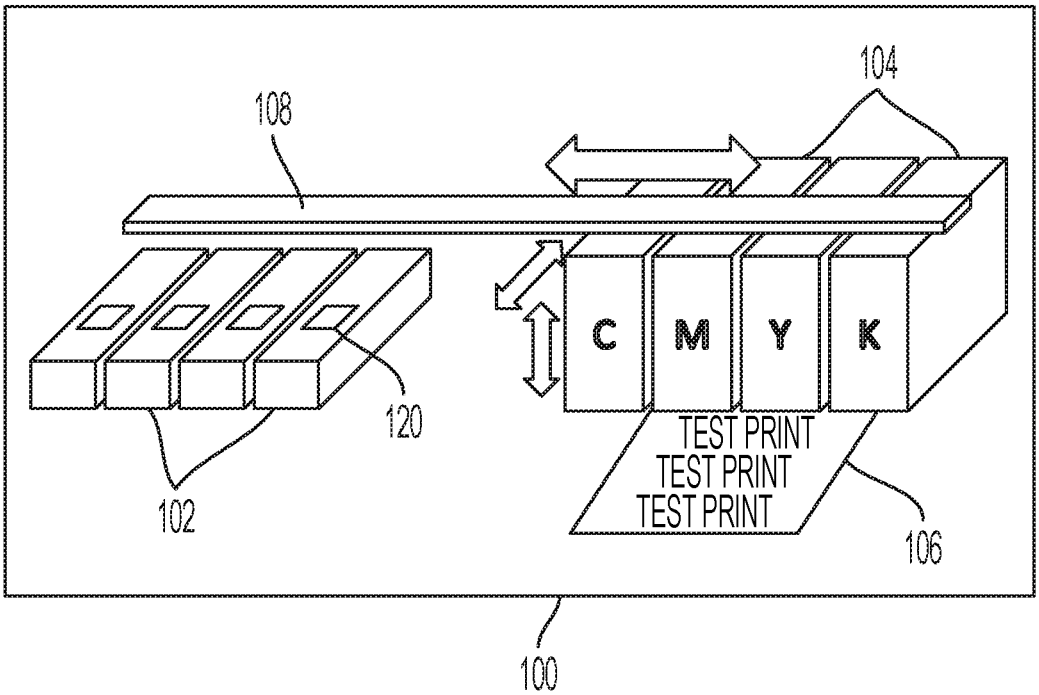
FIGS. 1 and 2 are perspective/exploded conceptual diagrams illustrating inkjet print cartridges and cartridge resting locations of structures herein.

As mentioned above, nozzles of inkjet printheads routinely clog when such are unused for extended periods, and purge and cleaning cycles are not completely effective at preventing clogs. In view of such issues, apparatuses herein provide a carriage assembly that has caps and that latches to the printhead to keep the ink from drying out.

More specifically, the structures herein provide an independent recovery printhead module (e.g., carriage assembly) that is made up of several components including a support tray, an undercarriage assembly, a capping cup support frame, capping cups, etc. The recovery printhead module can be positioned inside the printer's printhead maintenance frame assembly when the printhead module is in a rest position. Once installed, the recovery printhead module soaks and/or seals the printheads to keep the ink from drying out.

Therefore, when a printhead is not to be used for an extended period (e.g., overnight, over a weekend, during temporary storage, etc.) an operator can place the printhead module in a rest or non-printing position (or mode) and then install the recovery printhead module. To help latch the carriage assembly to the printhead, grooves or holes are formed in side plate rails on either side of a frame assembly of the printhead structure. When latching the carriage assembly to the printhead, one side (e.g., the left side) wheels/pins of the carriage assembly are positioned into the groove/holes in the left side rail and then a lever/latch in the undercarriage assembly can be activated to release the other (e.g., right side) wheels/pins into the opposing groove/holes, so as to latch or lock the recovery printhead module on to the printhead.

The operator can thus latch the recovery printhead module into place such that the printheads in the marker assembly will mate up with the capping cups of the recovery printhead module. Once the recovery printhead module is in place, the printheads and carrier plate assembly of the marker assembly can be lowered to mate up with the capping cups of the recovery printhead module.

With structures herein, differently sized and shaped caps can be provided. The caps can be easily and quickly mounted or removed to accommodate different nozzle or printhead configurations/sizes. The caps can be, for example, cups that maintain ink stabilizing liquid, sponges saturated in ink stabilizing liquid, a film coated with ink stabilizing liquid that contacts the jets of the printheads, etc. Further, the support plate for the caps can be mounted inside a support tray that catches and holds any spilled solution or material. Such a support tray can also support the undercarriage assembly.

These structures allow many options for positioning the recovery printhead module within the frame assembly. When printing is to resume, one side of the wheels (or pin support frame) can be pulled towards the center of the carriage assembly using the latch mechanism to unlock the recovery printhead module from the printhead, allowing the recovery printhead module to be easily removed from the printhead module. The recovery printhead module can then be cleaned and stored until required again.

Figure 2:
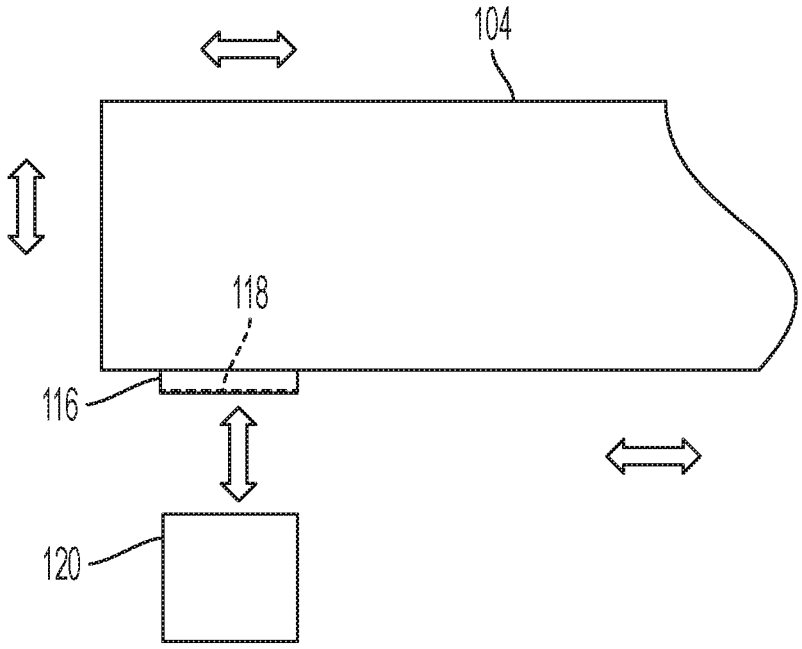

FIGS. 1 and 2 are perspective/exploded conceptual diagrams illustrating some components of an inkjet printing engine 100 that includes inkjet print cartridges 104 and cartridge resting structures 102. One or both of the cartridge resting structures 102 and the inkjet print cartridges 104 are movable along, for example, an actuator/track structure 108. In one example, the inkjet printer cartridges 104 are moved by the actuator/track structure 108 into a printing location to print markings on a sheet of print media 106. When not printing, the inkjet print cartridges 104 moves to a "parked," "resting," or "home" position where they can be manually or automatically latched to a carriage assembly 120 (that may be part of the cartridge resting structures 102). Note, as shown by the block arrows in FIGS. 1 and 2, the actuator/track structure 108 can move the inkjet print cartridges 104 and/or cartridge resting structures 102 in many different directions.

The inkjet print cartridges 104 can remain connected to the cartridge resting structures 102 unless the inkjet printing engine 100 is in the process of using the inkjet print cartridges 104 for printing. When printing markings on the sheet of print media 106, the inkjet printers 100 eject drops (droplets) of liquid marking material (e.g., ink, etc.) from nozzles 118 (jets) of inkjet printheads 116 in patterns to perform the printing on the print media 106. After printing, the inkjet print cartridges 104 can again return to the cartridge resting structures 102.

Figure 3:
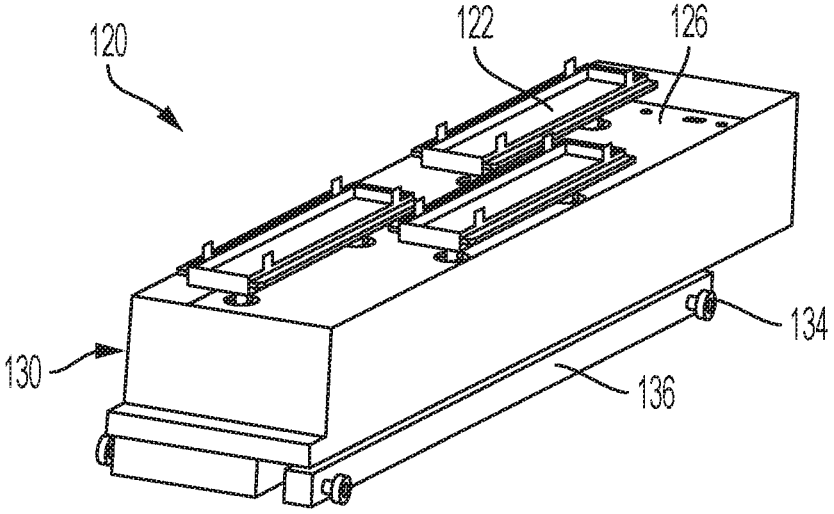
FIG. 3 is a perspective-view conceptual diagram illustrating carriage assembly and printhead cap structures herein.
Figure 4:
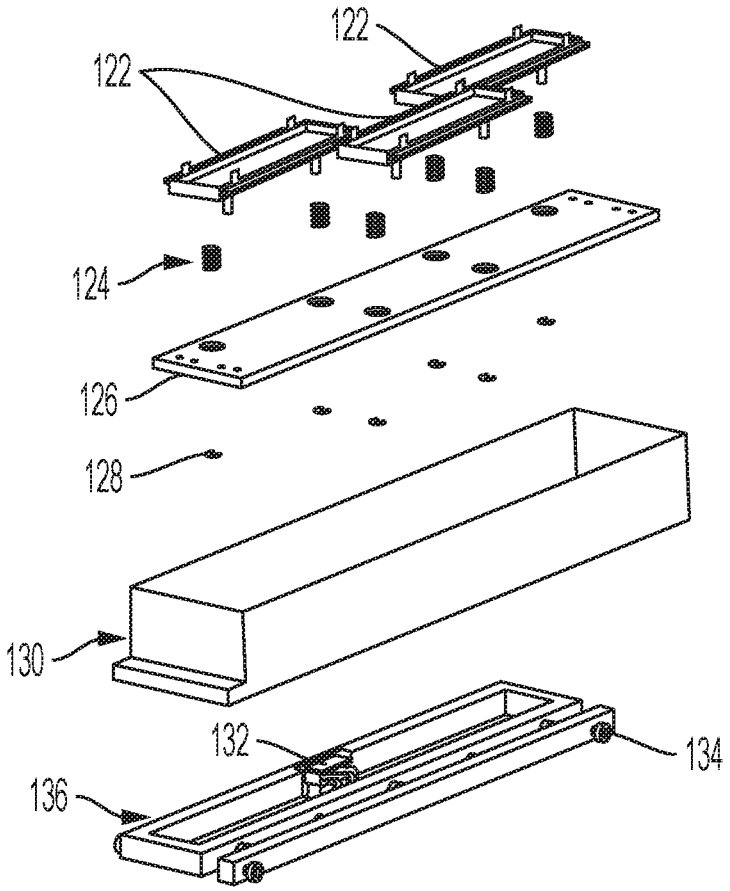
FIG. 4 is an exploded-view conceptual diagram of the carriage assembly and printhead cap structure shown in FIG. 3.
Figure 5:
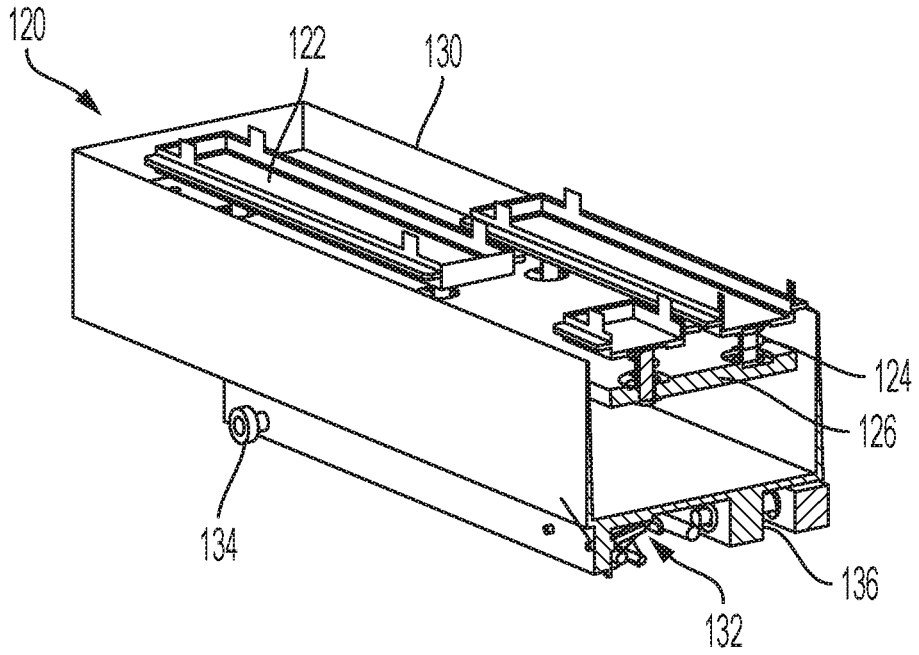
FIG. 5 is a cut away-view conceptual diagram of the carriage assembly and printhead cap structure shown in FIG. 3.
Figure 6:
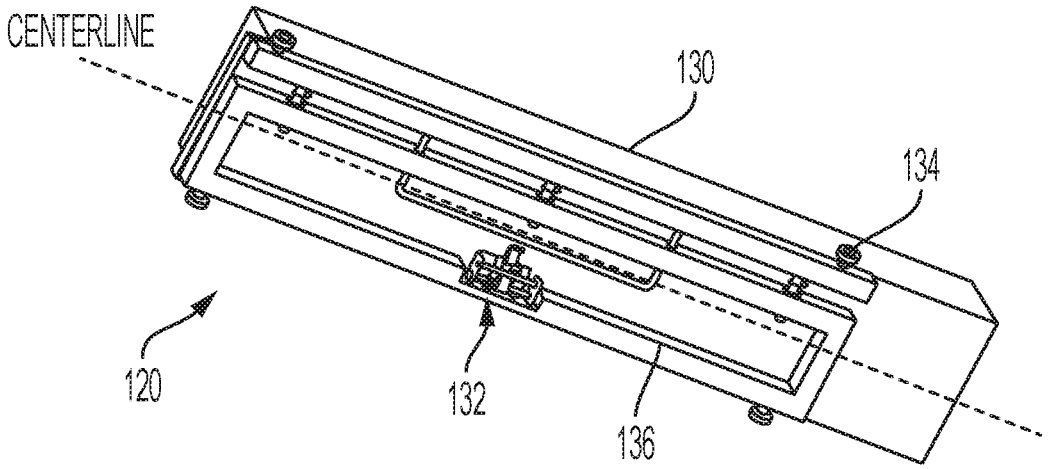
FIG. 6 is a bottom perspective-view conceptual diagram of the carriage assembly and printhead cap structure shown in FIG. 3.
Figure 7:
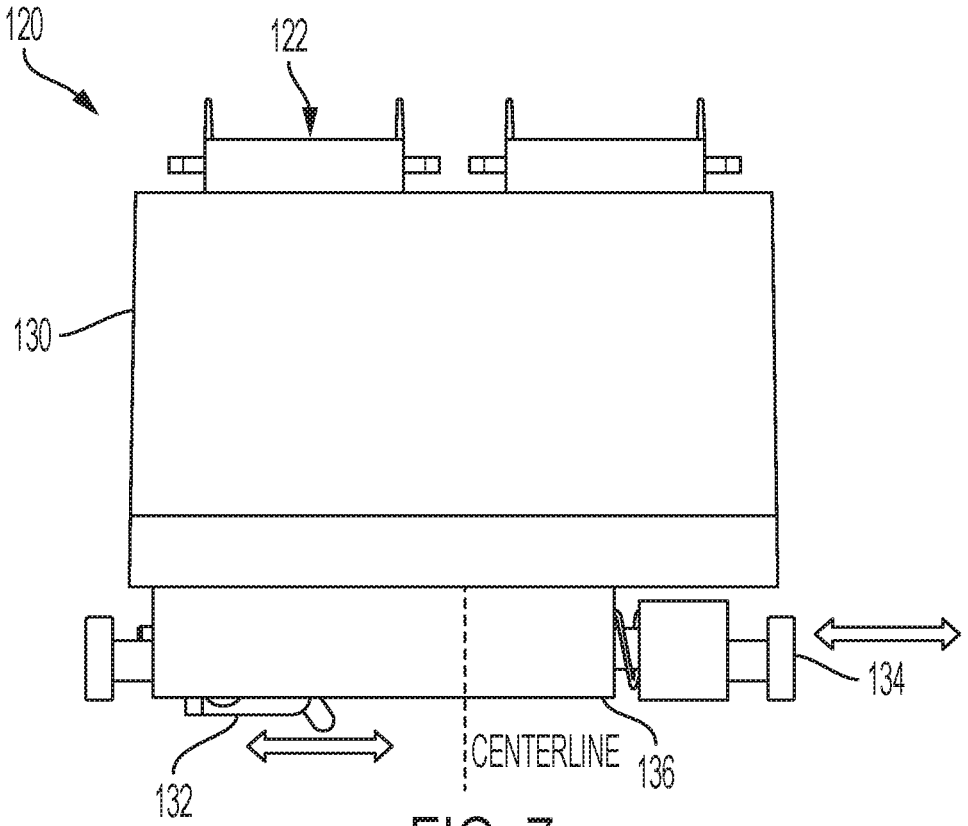
FIG. 7 is a front-view conceptual diagram of the carriage assembly and printhead cap structure shown in FIG. 3.

As noted previously, the nozzles 118 of such inkjet printheads routinely clog when such are unused for extended periods. In order to address such issues, as shown in FIGS. 3-7, apparatuses herein include, among other components, a carriage assembly 120. More specifically, FIG. 3 is a perspective-view conceptual diagram illustrating the carriage assembly 120, FIG. 4 is an exploded-view conceptual diagram of the carriage assembly 120 shown in FIG. 3, FIG. 5 is a cut away-view conceptual diagram of the carriage assembly 120 shown in FIG. 3, FIG. 6 is a bottom perspective-view conceptual diagram of the carriage assembly 120 shown in FIG. 3, and FIG. 7 is a front-view conceptual diagram of the 120 shown in FIG. 3.

As shown in FIGS. 3-4, the carriage assembly 120 has positioning structures 134 connected to a frame 136, and a lever structure 132 is connected to some of the positioning structures 134. Also, a cap support plate 126 is shown within the carriage assembly 120, and one or more printhead caps 122 (which can be in the form of replaceable cups) are on the cap support plate 126. The cap support plate 126 can be within, and supported by, a support tray 130. The support plate 126 is shaped to collect any liquids that flow out of the cups (caps 122). Also, springs 124 and connectors 128 can be included between the printhead cap support plate 126 and the printhead caps 122 to bias the printhead caps 122 against the nozzles 118 of the printhead 116.

The cutaway view shown in FIG. 5 illustrates how the springs 124 bias the caps 122 away from the support plate 126. Additionally, FIG. 5 illustrates how the positioning structures 134 are connected to, and extend from, a centerline of the frame 136.

The bottom view shown in FIG. 6 illustrates how the latch 132 is connected to the frame 136 and how movement of the latch 132 moves one side of the positioning structures 134 toward and away from the centerline of the frame 136. As explained in greater detail below, actuation of the latch 132 moves the positioning structures 134 away from the centerline of the frame 136 in order to engage the positioning structures 134 with corresponding structures (items 144, discussed below) of the printhead structure 116.

In a similar way, in the end of view shown in FIG. 7, the block double arrows illustrate that movement of the lever of the latch 132 toward and away from the centerline of the frame 136 moves the positioning structures 134 on one side of the frame 136 toward and away from the centerline.

Figure 8:
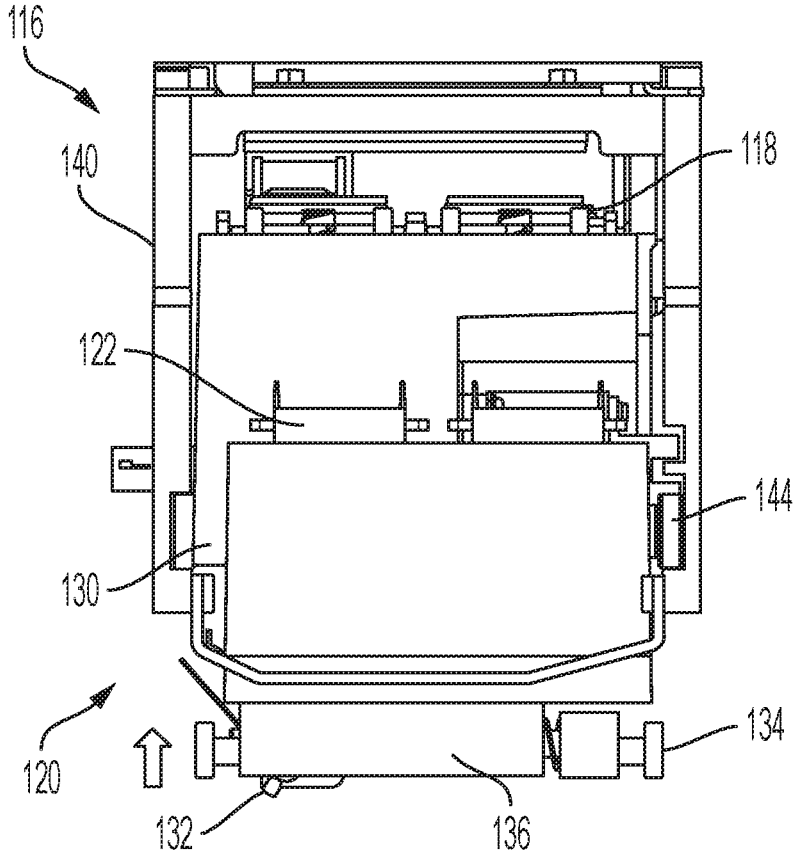
FIGS. 8-10 are front-view conceptual diagrams of the carriage assembly and printhead cap structure shown in FIG. 3 connected to a printhead.
Figure 9:
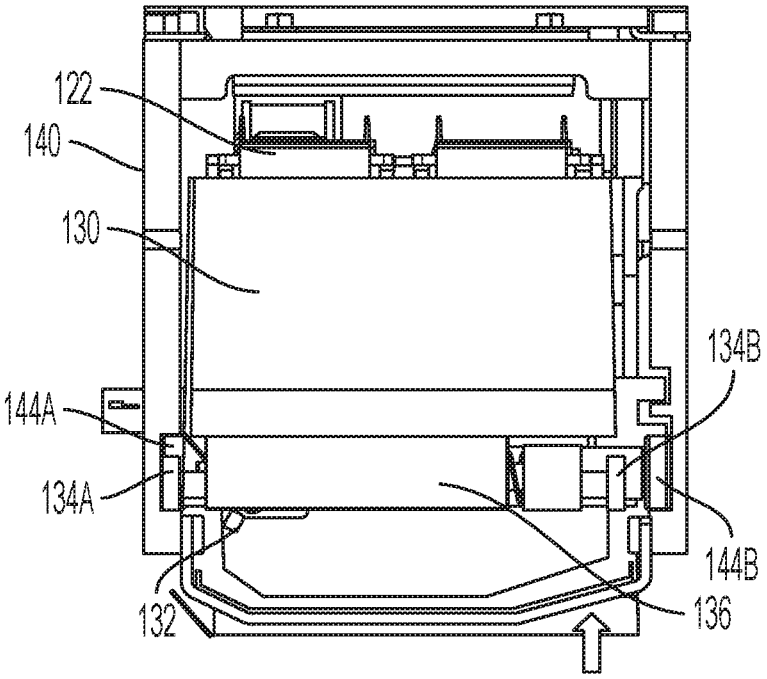
Figure 10:
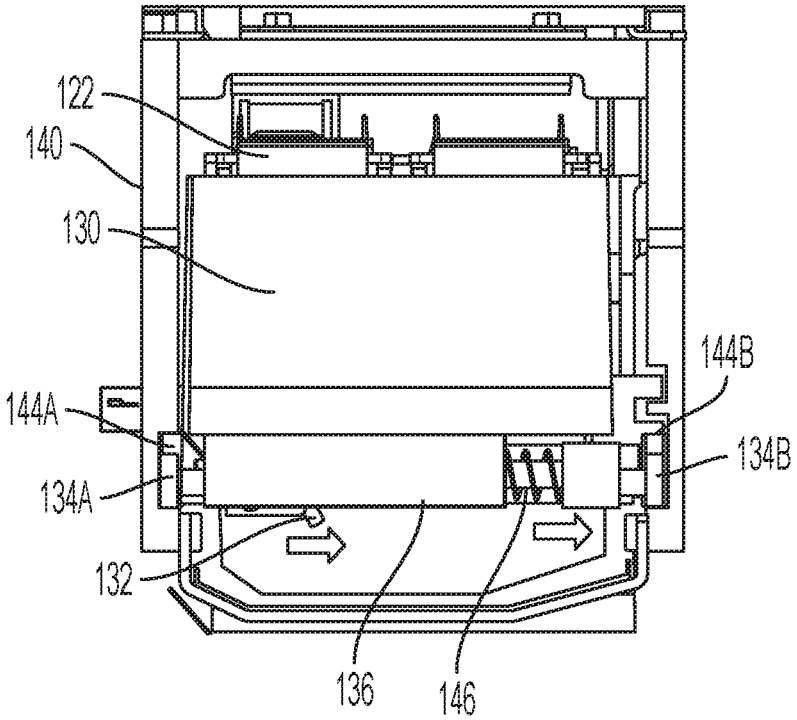
Figure 11:
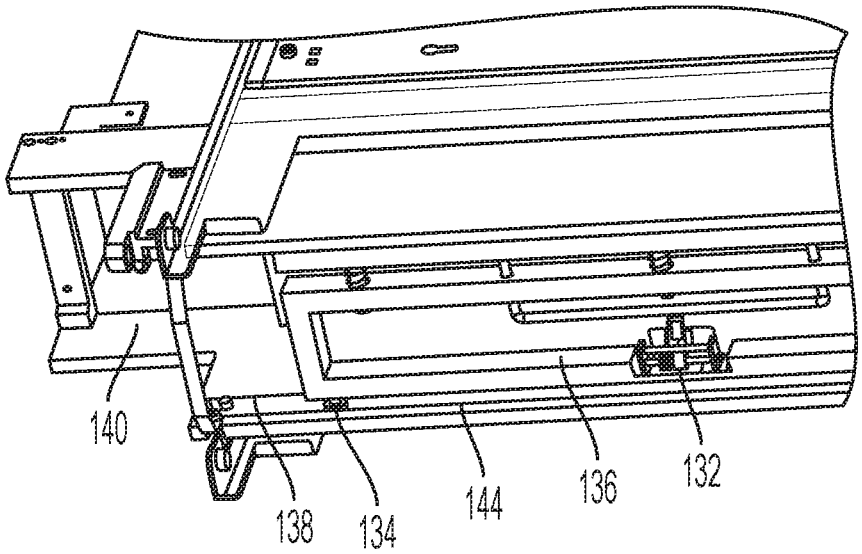
FIG. 11 is a partial bottom perspective-view conceptual diagram of the carriage assembly and printhead cap structure shown in FIG. 3 connected to a printhead.
Figure 12:
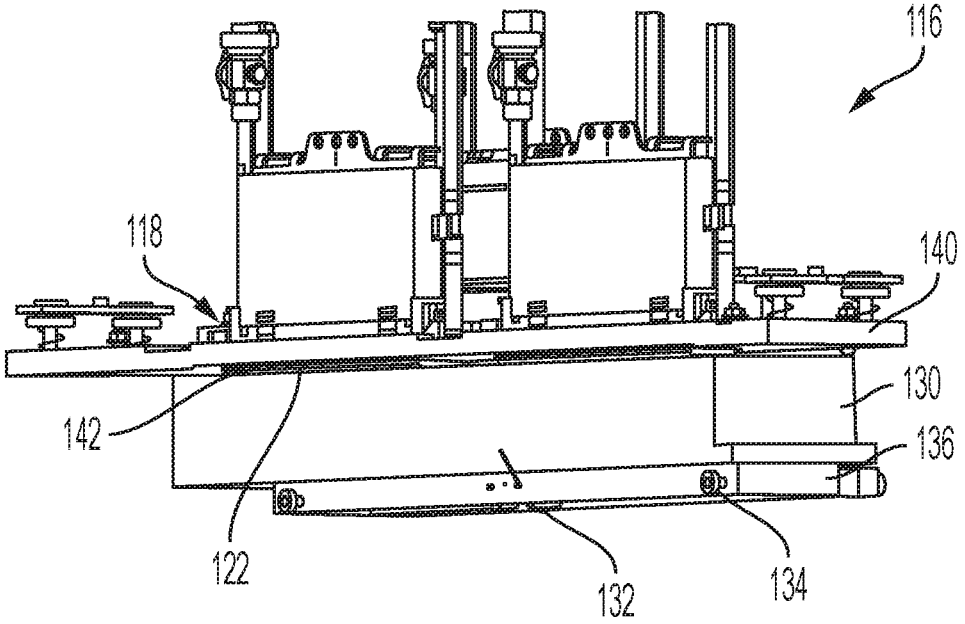
FIG. 12 is a perspective-view conceptual diagram of the carriage assembly and printhead cap structure shown in FIG. 3 connected to a printhead.
Figure 13:
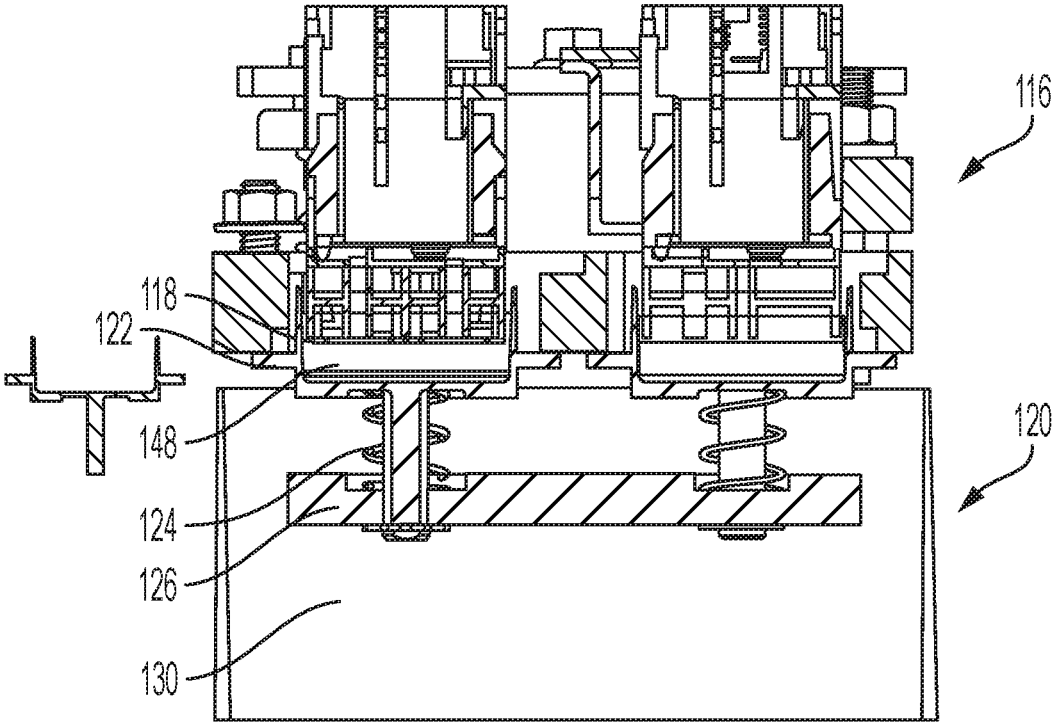
FIGS. 13-14 are front-view cut away conceptual diagrams of the carriage assembly and printhead cap structure shown in FIG. 3 connected to a printhead.

FIGS. 8-13 are conceptual diagrams of the carriage assembly 120 and printhead cap 116 structure shown in FIG. 3 connected to a printhead 116, wherein FIGS. 8-10 are front-view; FIG. 11 is a partial bottom perspective-view; FIG. 12 is a perspective-view conceptual diagram; and FIG. 13 is a front-view cut away diagram. As shown, the carriage assembly 120 is shaped to connect to the printhead structure 116.

As shown in FIGS. 8-13, the printhead structure 116 includes a printhead frame 140, nozzle structures 118, and corresponding structures 144. As explained below, the positioning structures 134 engage with the corresponding structures 144 of the printhead structure 116 when the carriage assembly 120 is connected to the printhead structure 116. Also, the printhead cap 122 is positioned within the carriage assembly 120 to cover the nozzles 118 when the carriage assembly 120 is connected to the printhead structure 116.

More specifically, FIG. 8 illustrates the carriage assembly 120 being partially positioned/installed within the frame 140 of the printhead structure 116. FIG. 9 illustrates the carriage assembly 120 positioned further within the frame 140. As can be seen in FIG. 9, this movement of the carriage assembly 120 move the caps 122 into a position where the caps 122 cover the nozzle structures 118.

Additionally, FIG. 9 illustrates that the positioning structures 134A on one side (e.g., left side, in the drawing) of the carriage assembly 120 are located in the corresponding structures 144A that are on the same side (e.g., left side) of the printhead structure 116; however, the positioning structures 134A on the other side (e.g., right side) of the carriage assembly 120 are located adjacent to, but outside, the corresponding structures 144A that are on that side (e.g., right side) of the printhead structure 116. FIG. 10 illustrates the carriage assembly 120 in the same position that it is shown in FIG. 9; however, in FIG. 10, the latch 132 is moved toward one side of the frame 136 (e.g., to the right in this example) which moves the (e.g., right side) positioning structures 134B into the (e.g., right side) corresponding structures 144B in order to latch the carriage assembly 120 onto the printed structure 116.

Note that the latch 132 can be a manually operated latch, or the latch 132 can include an actuator that automatically latches the latch 132 in order to automatically engage the positioning structures 134 into the corresponding structures 144. Therefore, the carriage assembly 120 can be a standalone structure that can be manually connected to any printhead (to reduce costs, simplify operation, provide backward compatibility, etc.), or the carriage assembly 120 can be a fully automated item that automatically moves to the printhead structure 116 (using the actuator/track structure 108) and automatically latches to the printhead structure 116 (using the power actuated latch structure 132) to provide improved user convenience. In either implementation, the caps 122 can be quickly and easily changed to match different nozzle and printhead sizes and shapes.

Additionally, as shown in FIG. 10, the frame 136 can include a biasing member 146 which helps maintain the positioning structures 134 within the corresponding structures 144. FIG. 11 illustrates a partial bottom view of the same carriage assembly 120 latched to the printhead structure 116 that is shown in FIGS. 9-10, and FIG. 11 shows the positioning structures 134 engaged in the corresponding structures 144. Additionally, FIG. 11 illustrates that a location control structure 138 (e.g., wheel contact, stop structure, etc.) can be included within the corresponding structures 144 in order to position the carriage assembly 120 relative to the printhead structure 116.

Therefore, FIGS. 9-11 illustrate that the latch 132, positioning structures 134, and corresponding structures 144 act in concert to positively lock the carriage assembly 120 to the printhead structure 116. This allows the caps 122 to consistently remain on the nozzles 118 so as to constantly apply ink stabilizing liquid to the nozzles 118 during extended storage. Keeping the caps 122 in a position to cover the nozzles 118 prevents the ink within the nozzles 118 from drying out and possibly re-liquefies any dried ink that may be within the nozzles 118 to help recover clogged nozzles.

FIG. 12 similarly illustrates a perspective view of the same carriage assembly 120 latched to the printhead structure 116 that is shown in FIGS. 9-11, and FIG. 12 shows that ribs 142 on the caps 122 can be utilized to limit how far the nozzle structures 118 extend into the caps 122.

FIG. 13 is a cross-sectional view showing a portion of the printhead structure 116 and a portion of the carriage assembly 120. FIG. 13 illustrates that such structures can also include an applicator 148 (such as a foam pad, cloth pad, thin film, solid block structure, etc.) within the cap 122. As shown in FIG. 13, the applicator 148 is positioned within the printhead cap 122 to rest against the nozzles 118 when the carriage assembly 120 is connected to the printhead structure 116.

Figure 14:
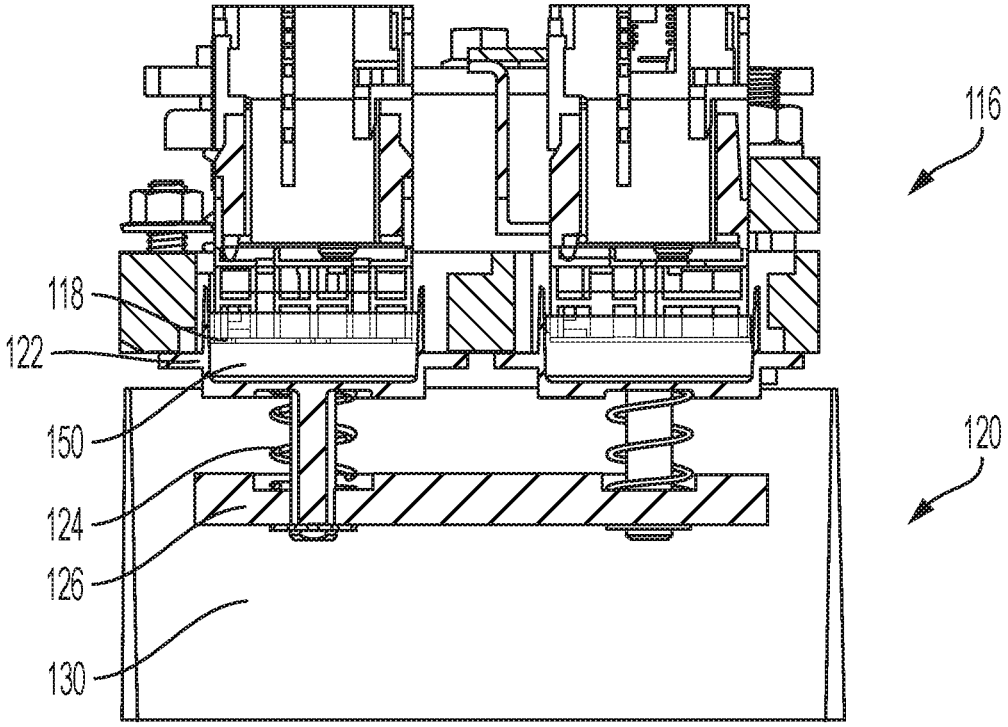

FIG. 14 is similar to FIG. 13, except FIG. 14 illustrates ink stabilizing material 150 in the caps 122. The ink stabilizing material 150 can be any material (liquid, gel, powder, etc.) that has the ability to keep liquid ink from drying. For example, the ink stabilizing material 150 can be water, cleaning solution (with or without detergents), solvents, co-solvents, ink (with or without pigments), etc., or any combination of such materials. As shown in FIG. 14, the caps 122 (replaceable cups) have an opening sized larger than a perimeter of the nozzle structures 118 of the printhead structure 116 to allow the nozzle structures 118 to enter the cup openings, and the caps 122 have a shape (cup interior) that is shaped to maintain a liquid (the ink stabilizing material 150) and that is sized to allow the nozzle structures 118 to be at least partially immersed in the ink stabilizing material 150 when the nozzle structures 118 are inserted into the cups 122.

Figure 15:
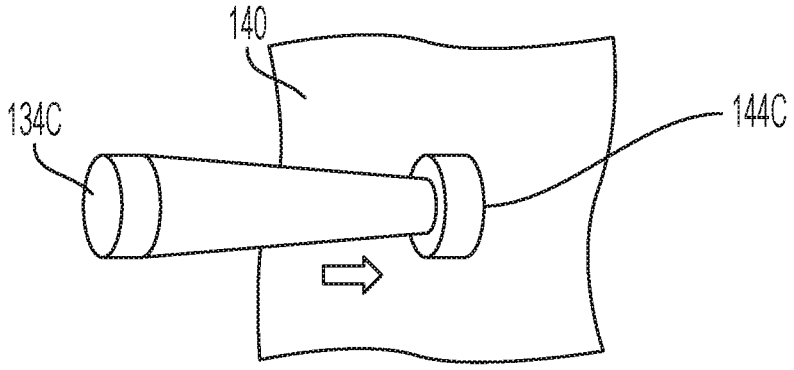
FIG. 15 is are partial conceptual diagrams of positioning and corresponding structures according to embodiments herein.
Figure 16:
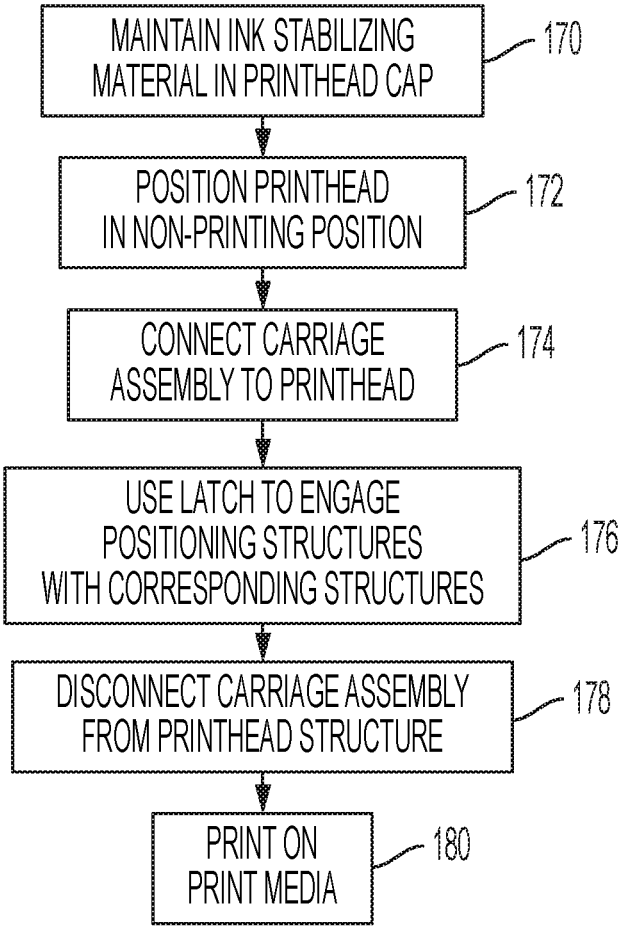
FIG. 16 is a flowchart illustrating methods herein.

As shown in FIG. 15, the corresponding structures 144 of the printhead structure 116 can be openings or holes 144C, and the positioning structures 134 can be pins 134C positioned to engage the openings/holes 144C when the carriage assembly 120 is connected to the printhead structure 116 through operation of the latch 132, as described above.

Aspects of some methods herein are shown in flowchart form in FIG. 12. In item 170, these methods maintain ink stabilizing material in a printhead cap of a carriage assembly. With these methods the ink stabilizing material is maintained in the printhead cap by, for example, partially filling the cap with a liquid or supplying the ink stabilizing material to an applicator within the cap.

These methods position a printhead structure in a non-printing position within a printing apparatus in item 172. Such methods manually or automatically connect the carriage assembly to the printhead structure in item 174. The process of connecting the carriage assembly to the printhead structure in item 174 includes using springs between the printhead cap and the carriage assembly to bias the printhead cap against the nozzles.

Then, in item 176, the methods herein utilized the latch to engage the positioning structures of the carriage assembly with corresponding structures of the printhead structure. As noted above, the corresponding structures of the printhead structure can be slots/openings and the positioning structures can be wheels/pins; and the process of engaging the carriage assembly to the printhead structure in item 176 includes the process of engaging the wheels/pins within the slots/openings by moving the latch lever. When the carriage assembly is latched to the printhead structure, the printhead cap of the carriage assembly covers nozzles of the printhead structure. With such, the applicator is positioned within the printhead cap to rest against the nozzles when the carriage assembly is connected to the printhead structure. Also, such methods can collect liquids that flow out of the printhead cap using a support tray that the cap is within.

After storage, the carriage assembly is disconnected from the printhead structure in item 178 and these methods perform printing using the printhead structure by ejecting ink from the nozzles in item 180.

Figure 17:
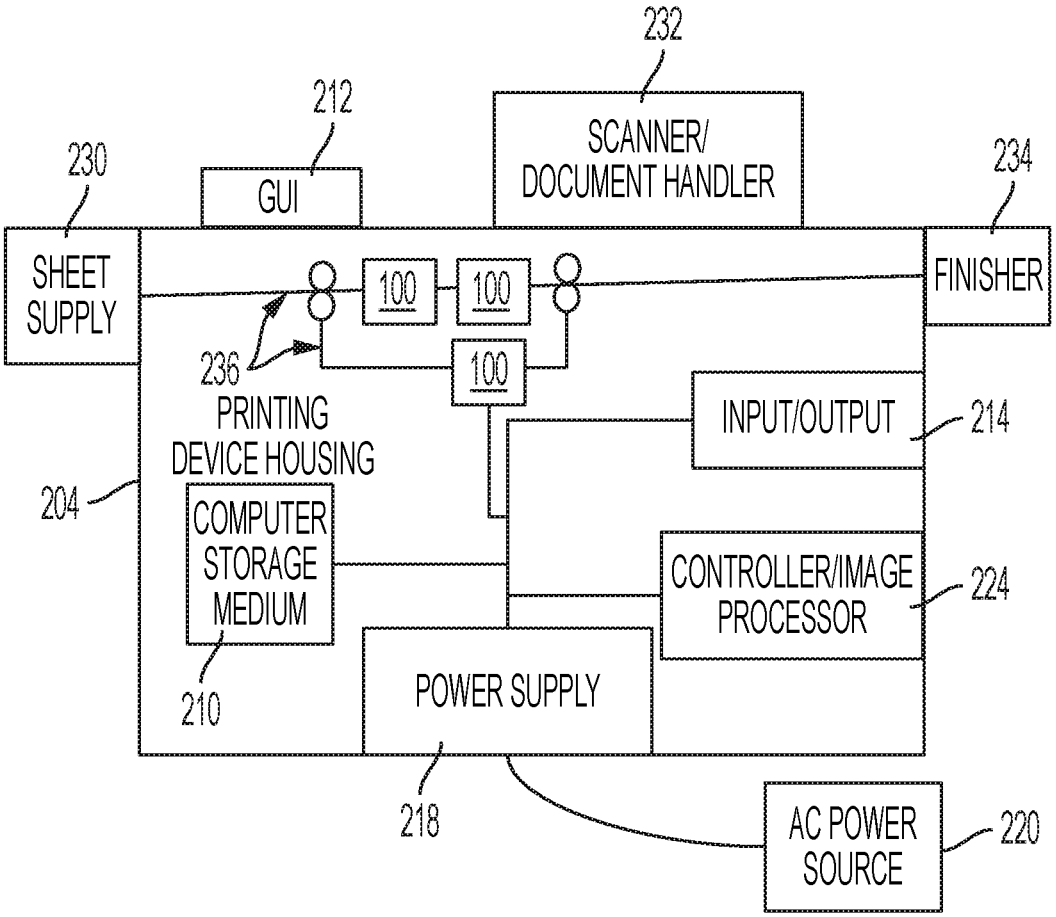
FIG. 17 is a conceptual diagram illustrating printing devices herein.

FIG. 17 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 17, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 100 that use marking material, and are operatively connected to a specialized image processor 224 (that may be different from a general purpose computer because it is specialized for processing image data), a media path 236 positioned to supply continuous media or sheets of media from a sheet supply 230 to the marking device(s) 100, etc. After receiving various markings from the printing engine(s) 100, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 100 are intended to illustrate any marking device that applies marking material (toner, inks, organic material, etc.) to continuous media, sheets of media, fixed platforms, etc., in two- or three-dimensional printing processes, whether currently known or developed in the future. The printing engines 100 can include, for example, inkjet printheads, contact printheads, three-dimensional printers, etc.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a carriage assembly having positioning structures; and a printhead cap within the carriage assembly, wherein the carriage assembly is shaped to connect to a printhead structure, wherein the positioning structures engage with corresponding structures of the printhead structure when the carriage assembly is connected to the printhead structure, wherein the printhead structure comprises nozzles adapted to eject liquid ink, wherein the printhead cap is positioned within the carriage assembly to cover the nozzles when the carriage assembly is connected to the printhead structure, and wherein the corresponding structures of the printhead structure comprise slots, and wherein the positioning structures comprise wheels positioned to engage the slots when the carriage assembly is connected to the printhead structure.

2. The apparatus according to claim 1, further comprising a lever structure connected to ones of the positioning structures, wherein movement of the lever structure engages the positioning structures with the corresponding structures of the printhead structure.

3. The apparatus according to claim 1, wherein the printhead cap comprises replaceable cups having an opening sized larger than a perimeter of the printhead structure, and wherein the replaceable cups have a cup interior shaped to maintain a liquid and sized to allow the printhead structure to be immersed in the liquid.

4. The apparatus according to claim 1, further comprising an applicator within the printhead cap, wherein the applicator is positioned within the printhead cap to rest against the nozzles when the carriage assembly is connected to the printhead structure.

5. The apparatus according to claim 1, further comprising springs connected to the printhead cap, wherein the springs are adapted to bias the printhead cap against the nozzles.

6. The apparatus according to claim 1, further comprising:

a cap support plate within the carriage assembly; and a support tray, wherein the cap support plate is within the support tray, wherein the cap support plate is shaped to collect liquids that flow out of the printhead cap.

7. A printing apparatus comprising:

a printhead structure comprising nozzles adapted to eject liquid ink;

a carriage assembly having positioning structures; and a printhead cap within the carriage assembly, wherein the carriage assembly is shaped to connect to the printhead structure, wherein the printhead comprises corresponding structures and the positioning structures engage with the corresponding structures of the printhead structure when the carriage assembly is connected to the printhead structure, wherein the printhead cap is positioned within the carriage assembly to cover the nozzles when the carriage assembly is connected to the printhead structure, and wherein the corresponding structures of the printhead structure comprise slots, and wherein the positioning structures comprise wheels positioned to engage the slots when the carriage assembly is connected to the printhead structure.

8. The printing apparatus according to claim 7, further comprising a lever structure connected to ones of the positioning structures, wherein movement of the lever structure engages the positioning structures with the corresponding structures of the printhead structure.

9. The printing apparatus according to claim 7, wherein the printhead cap comprises replaceable cups having an opening sized larger than a perimeter of the printhead structure, and wherein the replaceable cups have a cup interior shaped to maintain a liquid and sized to allow the printhead structure to be immersed in the liquid.

10. The printing apparatus according to claim 7, further comprising an applicator within the printhead cap, wherein the applicator is positioned within the printhead cap to rest against the nozzles when the carriage assembly is connected to the printhead structure.

11. The printing apparatus according to claim 7, further comprising springs connected to the printhead cap, wherein the springs are adapted to bias the printhead cap against the nozzles.

12. The printing apparatus according to claim 7, further comprising:

a cap support plate within the carriage assembly; and a support tray, wherein the cap support plate is within the support tray, wherein the cap support plate is shaped to collect liquids that flow out of the printhead cap.

13. A method comprising:

maintaining ink stabilizing material in a printhead cap of a carriage assembly;

positioning a printhead structure in a non-printing position within a printing apparatus;

connecting the carriage assembly to the printhead structure by engaging positioning structures of the carriage assembly with corresponding structures of the printhead structure, wherein the printhead cap of the carriage assembly covers nozzles of the printhead structure when the carriage assembly is connected to the printhead structure;

disconnecting the carriage assembly from the printhead structure;

printing using the printhead structure by ejecting ink from the nozzles; and wherein the corresponding structures of the printhead structure comprise slots, wherein the positioning structures comprise wheels, and wherein the connecting the carriage assembly to the printhead structure comprises engaging the wheels within the slots.

14. The method according to claim 13, wherein the connecting the carriage assembly to the printhead structure comprises moving a lever structure connected to ones of the positioning structures to engage the positioning structures with the corresponding structures of the printhead structure.

15. The method according to claim 13, wherein the maintaining the ink stabilizing material in the printhead cap comprises supplying the ink stabilizing material to an applicator within the printhead cap, wherein the applicator is positioned within the printhead cap to rest against the nozzles when the carriage assembly is connected to the printhead structure.

16. The method according to claim 13, wherein the connecting the carriage assembly to the printhead structure comprises using springs connected to the printhead cap to bias the printhead cap against the nozzles.

17. The method according to claim 13, further comprising collecting liquids that flow out of the printhead cap using a support tray the printhead cap is within.

* * * * *